US005261773A

United States Patent [19]

Thomas

[11] Patent Number: 5,261,773

[45] Date of Patent: Nov. 16, 1993

[54] APPARATUS FOR MARINE HOSE-RELATED SPILL PROTECTION

[75] Inventor: Craig R. Thomas, Lothian, Md.

[73] Assignee: Mobil Oil Corporation, Fairfax, Va.

[21] Appl. No.: 809,000

[22] Filed: Dec. 17, 1991

[51] Int. Cl.[5] ..... B63B 27/30

[52] U.S. Cl. ..... 414/141.8; 141/86; 137/312; 405/52

[58] Field of Search ..... 414/141.8, 143.1, 138.2, 414/138.4, 138.7; 141/86, 87, 88; 137/899.2, 312

[56] References Cited

U.S. PATENT DOCUMENTS

| | | | |
|---|---|---|---|
| 426,301 | 4/1890 | Musgrave et al. | 414/143.1 X |
| 1,752,410 | 4/1930 | Adams | 414/141.8 |
| 2,270,437 | 1/1942 | Herendeen | 414/143.1 X |
| 2,334,779 | 11/1943 | Luff | 137/312 X |
| 3,658,101 | 4/1993 | Waldron | 137/312 X |
| 3,756,294 | 9/1973 | Rainey | 137/312 X |
| 4,580,372 | 4/1986 | Osborn | 52/3 |

FOREIGN PATENT DOCUMENTS 1128811 4/1962 Fed. Rep. of Germany .

*Primary Examiner*—Robert P. Olszewski
*Assistant Examiner*—Dean A. Reichard
*Attorney, Agent, or Firm*—Alexander J. McKillop; George W. Hager, Jr.; Michael J. Mlotkowski

[57] ABSTRACT

A protective apparatus for the collection and redirection of a liquid spilled during the transfer thereof between a vessel and a transfer point, the transfer point spaced apart at a distance from the vessel, the distance subject to change due to relative movement therebetween. The apparatus includes a sheet of flexible material having a first end affixable to the vessel and a second end affixable to the transfer point, the flexible sheet being of a length sufficient to traverse the distance between the vessel and the transfer point, the flexible sheet having first and second longitudinal edges which have inflatable hollow chambers joined along the first and second edges of the flexible sheet.

17 Claims, 4 Drawing Sheets

APPARATUS FOR MARINE HOSE-RELATED SPILL PROTECTION

FIELD OF THE INVENTION

The present invention relates to the field of marine transportation and, more particularly, to the transportation of liquid products of a highly valuable and/or an environmentally sensitive nature.

BACKGROUND OF THE INVENTION

In the transportation of bulk liquid cargo, such as valuable chemicals, petroleum products and the like, sea-going vessels such as tankers and freighters are often employed. Although sea transport is highly effective and virtually always without incident, ecological damage often occurs in the event of an accident due to the fact that such a vast quantity of material is transported at one time. The great ecological damage resulting from a spill has been brought to the public's attention through several recent well-publicized incidents.

While the majority of these incidents are the result of shipwrecks and other sea-going accidents, a review of spills over the past several years reveals that hose related spills can account for a significant number of such incidents. As those experienced in marine transport recognize, such spills occur during the loading and off-loading of liquid cargo, when hoses may burst and connections or seals may fail.

Although improvements in materials and the equipment utilized in the loading and off-loading of liquid cargo continues to improve and regardless of the fact that workers may exercise extreme caution and diligence while utilizing hoses and connections, spills during loading and off-loading of liquid product nevertheless periodically occur.

Therefore, what is needed is an apparatus which will contain any spillage of liquid cargo which may inadvertently occur in the loading and off-loading of that cargo.

SUMMARY OF THE INVENTION

In accordance with the present invention there is provided a protective apparatus for the collection and redirection of a liquid spilled during the transfer thereof between a vessel and a transfer point, the transfer point spaced apart at a distance from the vessel, the distance subject to change due to relative movement therebetween. The protective apparatus includes a sheet of flexible material having a first end affixable to the vessel and a second end affixable to the transfer point, the flexible sheet being of a length sufficient to traverse the distance between the vessel and the transfer point, the flexible sheet having first and second longitudinal edges; a first inflatable hollow chamber joined along the first edge of the flexible sheet; a second inflatable hollow chamber joined along the second edge of the flexible sheet.

Also provided is a another protective apparatus for the collection and redirection of a liquid spilled during the transfer thereof between a vessel and a transfer point, the transfer point spaced apart at a distance from the vessel, the distance subject to change due to relative movement therebetween. This protective apparatus includes a sheet of flexible material having a first end affixable to the vessel and a second end affixable to the transfer point, the flexible sheet being of a length sufficient to traverse the horizontal distance between the vessel and the transfer point; a plurality of cable restraining means, the cable restraining means positioned in at least two substantially parallel and horizontally disposed rows along the length of the flexible sheet; and an elongated member affixed to the second end of the flexible sheet.

Also provided is method of preventing the spillage of a liquid during the transfer thereof between a vessel having liquid transfer manifold connections and a transfer point having liquid transfer manifold connections, the transfer point spaced apart at a distance from the vessel, comprising the steps of: (a) installing an apparatus for the collection and redirection of a liquid spilled during transfer between a vessel and a transfer point from a location under the manifold connection of the vessel to a location under the manifold connection of the transfer point; (b) securing the apparatus installed in step (a) with tensioned cables; and (c) transferring the liquid; wherein any liquid spilled during the transfer thereof between the vessel and the transfer point is collected in the apparatus installed in step (a).

In use, prior to the connection of hoses and/or loading arms the protective apparatus is spread or rolled out from the drip pan or containment barrier under the manifold connection of the transport vessel, over the rail of the vessel, to the shoreside drip pan or containment barrier under the manifold connection at the transfer point. Sufficient slack is provided for tide and vessel movement during cargo loading/off-loading or fueling operations. The protective apparatus is of sufficient width, generally 20 to 30 feet in the usual case, to lay under all hoses and/or loading arms. In a preferred embodiment, the edges of the apparatus are provided with hollow chambers which can be inflated to channel any spilled product towards the vessel or shore in the event of a hose or loading arm rupture. As may be appreciated by those skilled in the art, the protective apparatus of the present invention can be utilized for lightering operations as well as ship to shore transfers.

Accordingly, it is an object of the present invention to provide a protective apparatus for the collection and redirection of a valuable and/or environmentally hazardous liquid spilled during the transfer thereof between a vessel and a transfer point.

It is another object of the present invention to provide a method of preventing the spillage of a liquid during the transfer between a vessel and a transfer point.

Other objects and the several advantages of the present invention will become apparent to those skilled in the art upon a reading of the specification and the claims appended thereto.

BRIEF DESCRIPTION OF THE DRAWINGS

Reference may now be had to the following detailed description of exemplary embodiments of a protective apparatus in accordance with the present invention, taken in conjunction with the accompanying drawings; in which.

DETAILED DESCRIPTION OF THE INVENTION

The present invention is best understood by reference to the appended figures, which are given by way of example and not of limitation.

Figure 1:
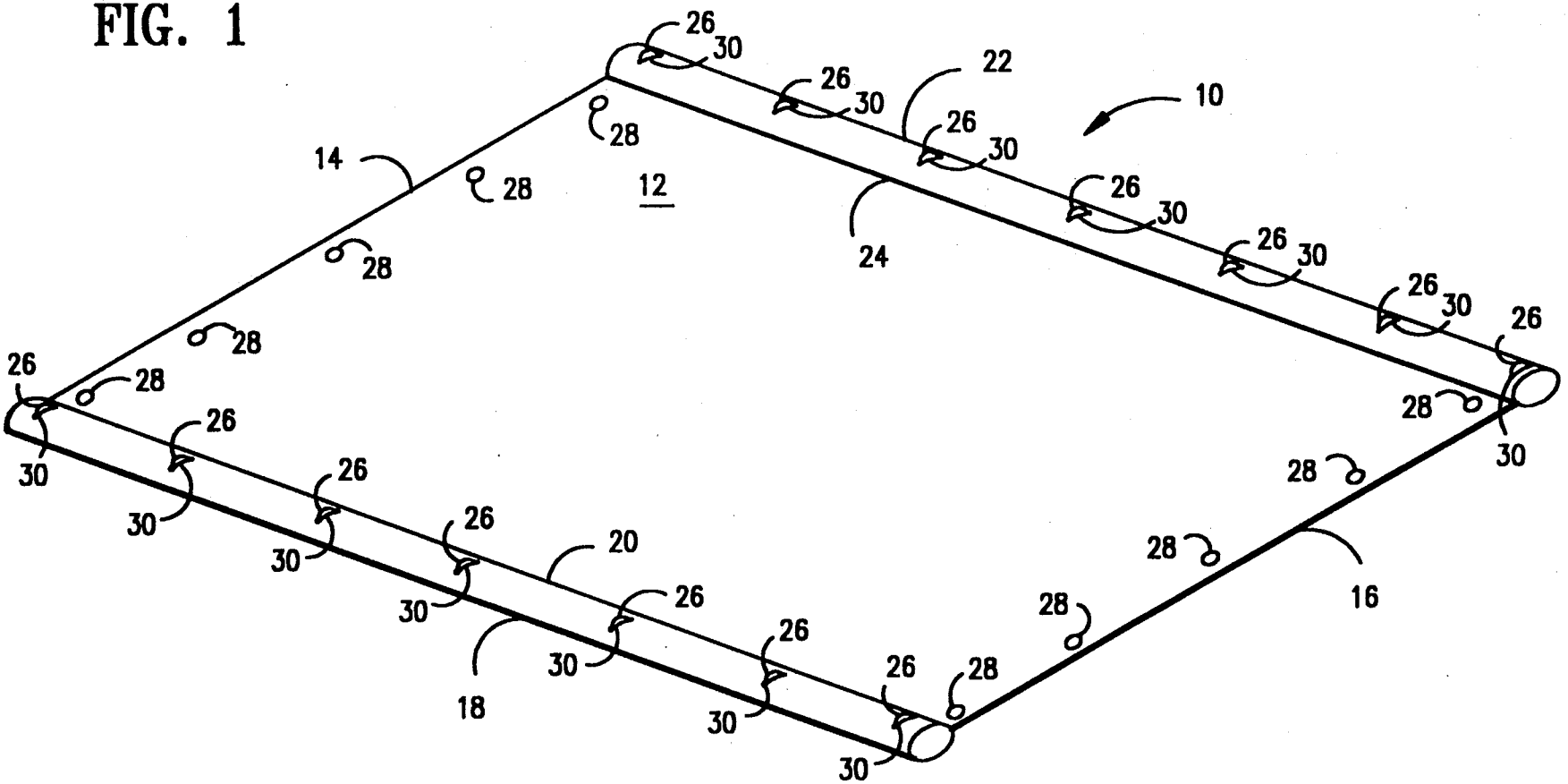
FIG. 1 illustrates a perspective view of a protective apparatus incorporating inflatable longitudinal hollow chambers in accordance with the present invention.

Referring now to FIG. 1, a preferred embodiment of a protective apparatus 10 for collecting a liquid spilled during the transfer of the liquid between a vessel and a transfer point, constructed in accordance with the present invention, is shown. Protective apparatus 10 includes a sheet of flexible material 12 having a first end 14 which may be affixed to a transport vessel and a second end 16 for affixing at the transfer point, which may be a manifold drip pan at a pier, dock, a second vessel or the like. As may be appreciated by those skilled in the art, flexible sheet 12 must be of a length sufficient to traverse the distance between the vessel and the transfer point, and provide sufficient slack to account for vessel movement during a loading or off-loading operation.

As is particularly preferred, protective apparatus 10 includes a first inflatable hollow chamber 18 joined along a first longitudinal edge 20 of flexible sheet 12 and a second inflatable hollow chamber 22 joined along a second edge 24 of flexible sheet 12. As indicated above, inflatable hollow chambers 18 and 22 serve to channel any spilled liquid product towards the vessel or shore in the event of a hose or loading arm rupture during a loading or off-loading operation.

Figure 2:
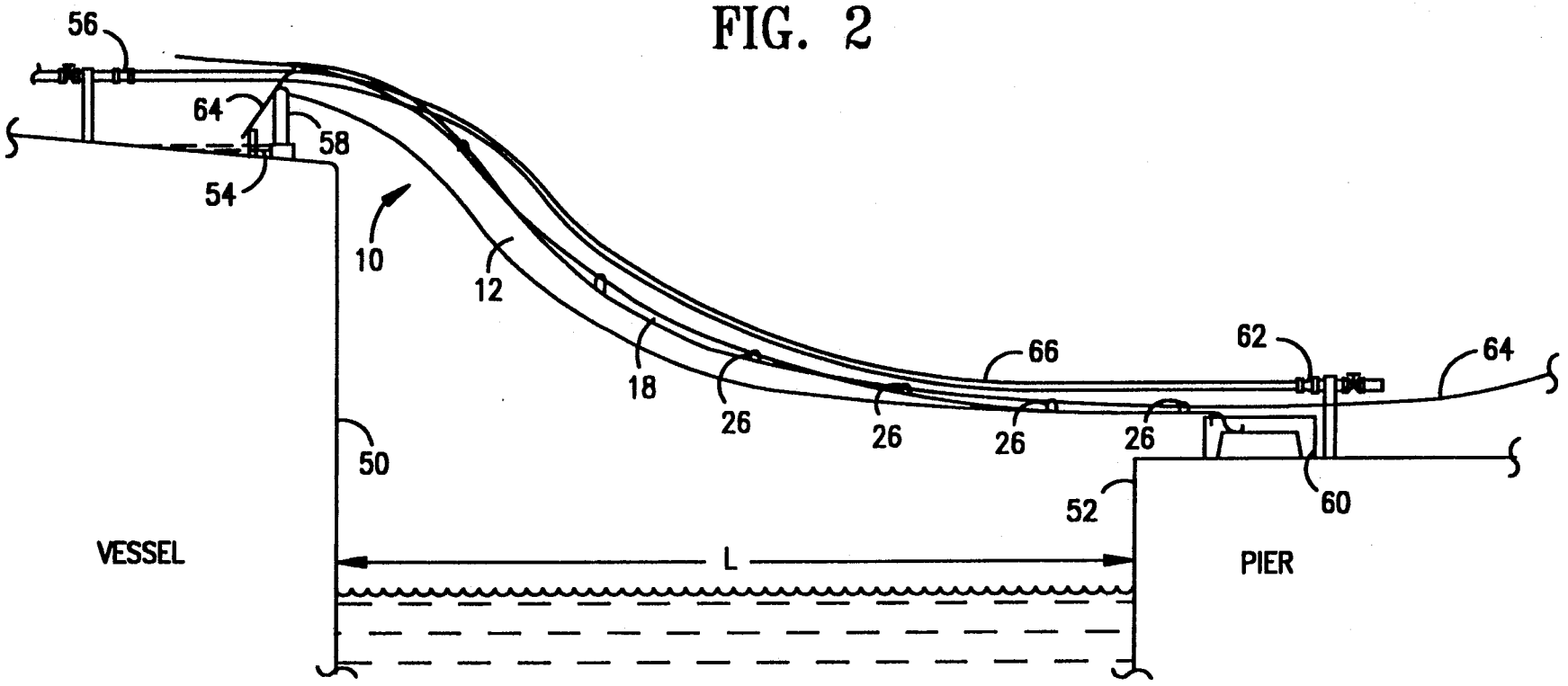
FIG. 2 presents a side view schematically illustrating a protective apparatus of the present invention in use in a ship to shore transfer of a liquid material.

As a further aid in channeling any spillage towards the vessel and/or shore in the event of a hose rupture, a plurality of cable restraining means 26 are positioned along the length apparatus 10 to form two spaced apart and longitudinally disposed rows for the passage of tensioned support cables therethrough (see FIG. 2). Particularly preferred for use as cable restraining means 26 are commercially available stainless steel "D"- rings of the type depicted in FIGS. 1, 2 and 4. Such "D"-rings are capable of supporting 150 lbs. without failure. The plurality of cable restraining means 26 are affixed to protective apparatus 10 in the usual manner employed by those skilled in the art of manufacturing inflatable life rafts, boats and the like, such an affixing procedure including the gluing or cementing of a section of flexible material 30 to flexible sheet 12 or inflatable chambers 18 and 22 (depending upon the location of the "D"- rings) to cover and restrain the flat portion of the "D"- ring. To provide the greatest control over the proper positioning of protective apparatus 10, the cable restraining means 26 are positioned at the first and second inflatable hollow chambers 18 and 22, respectively. As may be appreciated, at ship side, the "D"-rings allow the protective apparatus 10 to be adjusted and tied off to accommodate vessel movement, different tide and/or draft conditions, or different shore facility configurations while maintaining the integrity of the vessel's oil spill containment barrier. To aid in affixing each end of protective apparatus 10 during use, a plurality of grommets 28 are provided near first end 14 and second end 16 of protective sheet 12.

Figure 3:
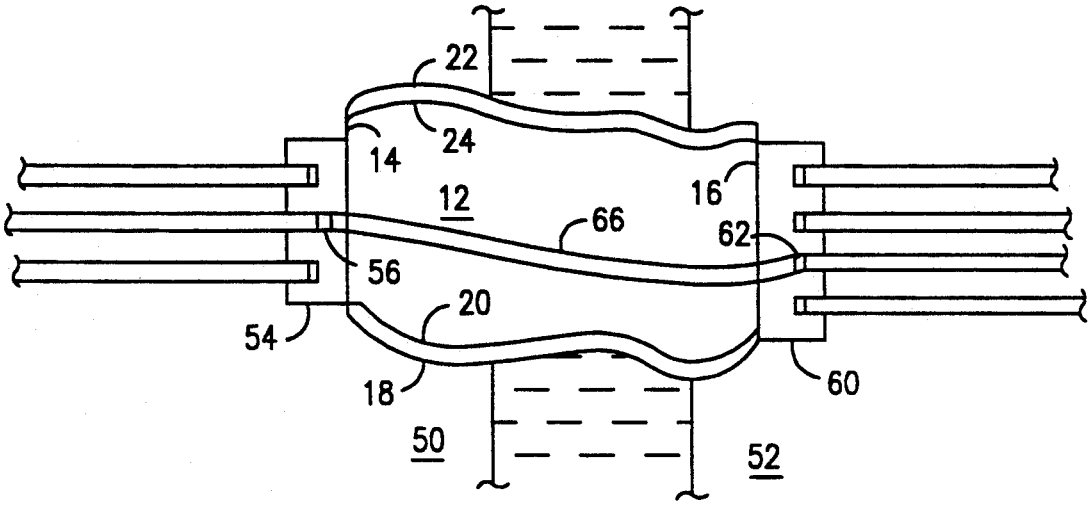
FIG. 3 presents an overhead view of the FIG. 2 illustration of a protective apparatus of the present invention in use in a ship to shore transfer of a liquid material.

Referring now to FIG. 2, a side view schematically illustrating a ship to shore transfer operation employing a protective apparatus 10 of the present invention is shown. Protective apparatus 10 is shown in place during an off-loading operation between vessel 50 and transfer point 52, which in the case depicted is a loading pier. Protective apparatus 10 is rolled out from the vessel's drip pan 54, which is located under the manifold connection 56, over the vessel's rail 58 and out to the shoreside drip pan 60, located under the pier's manifold connection 62. Tensioned support cables 64 are passed through cable restraining means 26 of apparatus 10 to channel any spillage towards the shore in the event of a rupture of liquid product transfer hose 66. As may be seen, the lowermost portion of flexible sheet 12 is shown extending well below inflatable hollow chambers 18 and 22 to effect the advantageous channelling of protective apparatus 10. Moreover, as can be appreciated, sufficient slack is provided for tide and vessel movement during the operation depicted in FIG. 2. FIG. 3 presents an overhead view of the FIG. 2 illustration of a protective apparatus of the present invention in use in a ship to shore transfer of a liquid material. As may be appreciated, any breakage in hose connections 56 or 62 or leaks in the transfer hose 66 will not result in a spillage of potentially harmful material into the water below.

Figure 5:
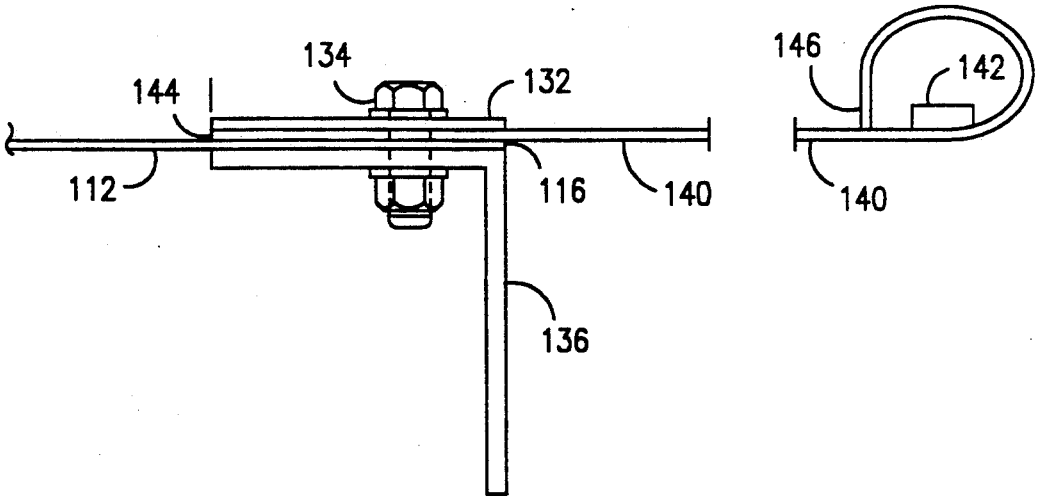
FIG. 5 presents an enlarged sectional view taken along line 5—5 of FIG. 4 an alternate embodiment of a protective apparatus in accordance with the present invention.
Figure 4:
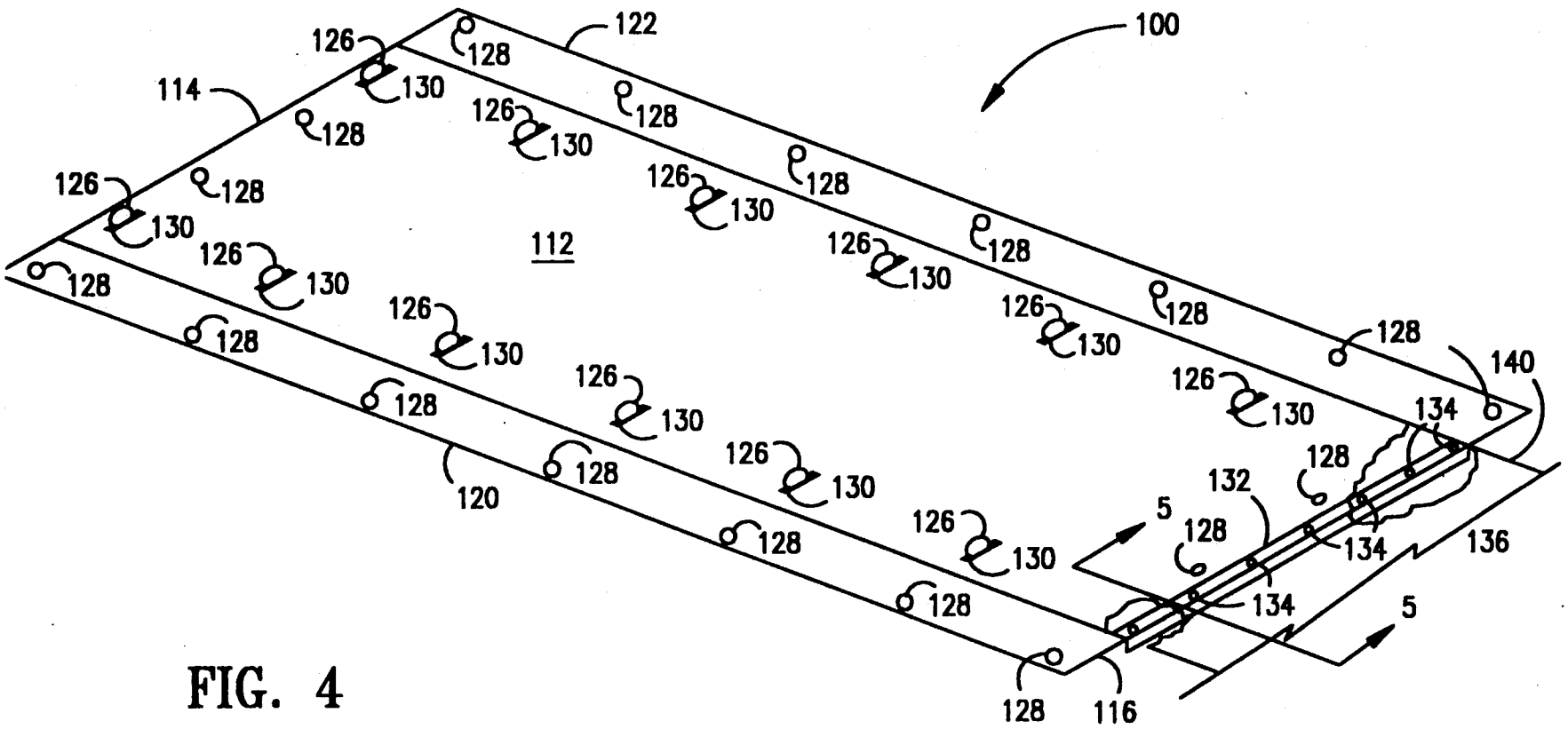
FIG. 4 presents a perspective view of an alternate embodiment of a protective apparatus in accordance with the present invention.

Referring now to FIG. 4, an alternate embodiment of a protective apparatus 100 for collecting a liquid spilled during the transfer of the liquid between a vessel and a transfer point, constructed in accordance with the present invention, is shown in partial cut-away. Protective apparatus 100 includes a sheet of flexible material 112 having a first end 114 which may be affixed to a transport vessel and a second end 116 for affixing at the transfer point, which may be a manifold drip pan at a pier, dock, a second vessel or the like. Again, flexible sheet 112 must be of a length sufficient to traverse the distance between the vessel and the transfer point, and provide sufficient slack to account for vessel movement during a loading or off-loading operation. Attached to second end 116 of flexible sheet 112 is an elongated angle member 136. As is preferred, elongated angle member 136 may be constructed of suitable angle stock, with aluminum angle stock of alloy 5086 being particularly preferred. In a particularly preferred embodiment, a weighted flap of flexible material 140 is also affixed to second end 116 of flexible sheet 112. Referring now to FIG. 5 an enlarged sectional view taken along line 5—5 of FIG. 4 is presented to illustrate the means for attachment of weighted flap 140 to second end 116 of flexible sheet 112. As may be seen, a plurality of holes are provided through a plate 132, fabricated from a length of flat stock, and through elongated angle member 136, for clamping and securing second end 116 of flexible sheet 112 to the first end 144 of weighted flap 140, when bolts 134 are positioned therethrough. Preferred in the fabrication of plate 132 is aluminum flat stock of alloy 5086. Also shown in FIG. 5 is weight 142 affixed to weighted flap 140 near its second end 146. Weight 142 may be fabricated from a section of steel flat stock or the like.

Referring again to FIG. 4, a plurality of cable restraining means 126 are positioned along the length of apparatus 100 to form two spaced apart and longitudinally disposed rows for the passage of tensioned support cables therethrough to aid in channeling any spillage towards the vessel and/or shore in the event of a hose rupture (see FIG. 2). Again, particularly preferred for use as cable restraining means 126 are commercially available stainless steel "D"- rings of the type described above. The plurality of cable restraining means 126 are affixed to protective apparatus 100 in the usual manner employed by those skilled in the art of manufacturing inflatable life rafts, boats and the like, such an affixing procedure including the gluing or cementing of a section of flexible material 130 to flexible sheet 112 to cover and restrain the flat portion of the "D"- ring. As indicated above, the "D"- rings allow the protective apparatus 100 to be adjusted and tied off to accommodate vessel movement, different tide and/or draft conditions, or different shore facility configurations while maintaining the integrity of the vessel's oil spill containment barrier. To aid in affixing each end of protective apparatus 10 during use, a plurality of grommets 128 are provided about the perimeter of flexible sheet 112. In use, the elongated angle member 136 is fastened to the edge of the shoreside manifold spill tank, drip pan or containment barrier 60 to enable the apparatus to be firmly affixed thereto. The weighted flap 140 is provided for placement directly into the shoreside manifold spill tank 60.

In selecting a material for use in fabricating the flexible sheet, inflatable hollow chambers and weighted flap, it is important that the material: exhibit good abrasive wear characteristics, be resistant to oil or oil based products; be resistant to tearing; have good flexure properties so that failure due to repeated folding or rolling is minimized; exhibit sufficiently stable properties that do not change over time or with exposure to a marine environment and sunlight. The material selected should additionally be an electrostatically free material capable of withstanding a 0.2 psi load over a 5' by 5' section, although the weighted end flap does not have any critical tensile strength requirement associated therewith. Painted canvas and neoprene-coated cloth are materials which can be produced to meet the above-listed requirements. Particularly preferred for use in the practice of the present invention is 60-ounce neoprene-coated nylon cloth. The protective apparatus should be of sufficient width, approximately 20 to 30 feet, to enable the apparatus to lay under all hoses and loading arms present in typical application.

As may be appreciated, the protective apparatus of the present invention could be utilized for lightering operations as well as ship to shore transfers. A bulk storage terminal could be provided with the protective apparatus for use with third party vessels.

The following prophetic example is presented to illustrate particular embodiments of the present invention and hence is illustrative of this invention and not to be construed in a limiting sense.

EXAMPLE

A protective apparatus is fabricated in accordance with the embodiment of FIG. 1. Prior to the connection of hoses and/or loading arms, the protective apparatus is rolled out from the vessel's drip pan under the manifold connection, over the vessel's rail and to the shoreside drip pan under the manifold connection. Sufficient slack is provided for tide and vessel movement during cargo or fueling operations. If connections are not be made to the drip pans an alternative would be to anchor the protective apparatus to the ground ashore and within the containment area on the vessel to ensure that any spilled liquid would not reach the water. The tensioned support cables are anchored and the hollow chambers inflated to channel any spillage towards the vessel and/or shore in the event of a hose rupture/loading arm rupture. The hoses are connected and an off-loading operation is begun. N spillage into the waters below is encountered.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the amended claims.

What is claimed is:

1. A protective apparatus for the collection and redirection of a liquid spilled during the transfer thereof between a vessel and a transfer point, the transfer point spaced apart at a distance from the vessel, the distance subject to change due to relative movement therebetween, comprising:

(a) a sheet of flexible material having a first end affixable to the vessel and a second end affixable to the transfer point, said flexible sheet being of a length sufficient to traverse the distance between the vessel and the transfer point, said flexible sheet having first and second longitudinal edges;

(b) a first inflatable hollow chamber joined along said first edge of said flexible sheet; and (c) a second inflatable hollow chamber joined along said second edge of said flexible sheet.

2. The protective apparatus of claim 1, further comprising a plurality of cable restraining means, said cable restraining means positioned to form at least a first and second spaced apart and longitudinally disposed row along the length of the apparatus.

3. The protective apparatus of claim 2, wherein said first row of said cable restraining means is positioned along said first inflatable hollow chamber and said second row of said cable restraining means is positioned along said second inflatable hollow chamber.

4. The protective apparatus of claim 3, wherein said flexible sheet is formed of a petroleum-resistant material.

5. The protective apparatus of claim 4, wherein said petroleum-resistant material is a neoprene-coated fabric.

6. The protective apparatus of claim 4, wherein said petroleum-resistant material is a neoprene-coated fabric.

7. The protective apparatus of claim 5, wherein said first inflatable hollow chamber and said second inflatable hollow chamber are fabricated of a petroleum-resistant material.

8. The protective apparatus of claim 7, wherein said petroleum-resistant material is a neoprene-coated fabric.

9. The protective apparatus of claim 1, wherein said first inflatable hollow chamber and said second inflatable hollow chamber are fabricated of a petroleum-resistant material.

10. The protective apparatus of claim 9, wherein said petroleum-resistant material is a neoprene-coated fabric.

11. A method of preventing the spillage of a liquid during the transfer thereof between a vessel having liquid transfer manifold connections and a transfer point having liquid transfer manifold connections, the transfer point spaced apart at a distance from the vessel, comprising the steps of:

(a) installing an apparatus for the collection and redirection of a liquid spilled during transfer between a vessel and a transfer point from a location under the manifold connection of the vessel to a location under the manifold connection of the transfer point, the apparatus including:

(i) a sheet of flexible material having a first end affixable to the vessel and a second end affixable to the transfer point, said flexible sheet being of a length sufficient to traverse the distance between the vessel and the transfer point, said flexible sheet having first and second longitudinal edges:

(ii) a first inflatable hollow chamber joined along said first edge of said flexible sheet; and (iii) a second inflatable hollow chamber joined along said second edge of said flexible sheet;

(b) securing the apparatus installed in step (a) with tensioned cables; and (c) transferring the liquid;

wherein any liquid spilled during the transfer thereof between the vessel and the transfer point is collected in the apparatus installed in step (a).

12. The method of claim 11, wherein the apparatus installed in step (a) further includes a plurality of cable restraining means, said cable restraining means positioned to form at least two spaced apart and longitudinally disposed rows along the length of the apparatus.

13. The method of claim 12, wherein said first row of said cable restraining means is positioned along said first inflatable hollow chamber and said second row of said cable restraining means is positioned along said second inflatable hollow chamber.

14. The method of claim 13, wherein said flexible sheet is formed of a petroleum-resistant material.

15. The method of claim 14, wherein said petroleum-resistant material is a neoprene-coated fabric.

16. The method of claim 14, wherein said petroleum-resistant material is a neoprene-coated fabric.

17. The method of claim 16, wherein said first inflatable hollow chamber and said second inflatable hollow chamber are fabricated of a petroleum-resistant material.

* * * * *